United States Patent [19]

Hix

[11] Patent Number: 4,858,914

[45] Date of Patent: Aug. 22, 1989

[54] BALANCE ENHANCING EXERCISE AND AMUSEMENT APPARATUS

[76] Inventor: Jimmy D. Hix, 4309 Action St., Bay No. 5, Garland, Tex. 75042

[21] Appl. No.: 218,627

[22] Filed: Jul. 13, 1988

[51] Int. Cl.[4] ..... A63B 25/08

[52] U.S. Cl. ..... 272/114; 272/134; 272/70.3; 180/81; 280/1.181

[58] Field of Search ..... 272/114, 115, 134, 144, 272/70, 70.3; 180/8.1, 8.5; 280/1, 1.11 R, 1.181, 1.182, 1.184, 1.191, 1.5, 200; 305/1

[56] References Cited

U.S. PATENT DOCUMENTS

| | | | |
|---|---|---|---|
| 219,439 | 9/1879 | Blend | 272/70 |
| 420,178 | 1/1890 | Yagn | 272/70 |
| 420,179 | 1/1890 | Yagn | 272/70 |
| 1,147,883 | 7/1915 | Olfort | 208/1.181 |
| 1,627,426 | 5/1927 | Briggs | 180/8.1 |
| 2,210,269 | 8/1940 | Taylor | 272/70.3 |
| 3,759,511 | 9/1973 | Zinkin et al. | 272/70 |
| 3,791,646 | 2/1974 | Marchignoni | 272/71 |
| 3,976,058 | 8/1976 | Tidwell | 272/134 |
| 4,265,326 | 5/1981 | Lauber | 180/8.1 |
| 4,411,443 | 10/1983 | Pollard | 280/281 |
| 4,639,007 | 1/1987 | Lawrence | 280/234 |

FOREIGN PATENT DOCUMENTS

| | | | |
|---|---|---|---|
| 122523 | 10/1946 | Australia | 280/1.182 |

*Primary Examiner*—Richard J. Apley

*Assistant Examiner*—J. Welsh

*Attorney, Agent, or Firm*—Hubbard, Thurman, Turner & Tucker

[57] ABSTRACT

An exercise machine adapted to simultaneously strengthen the user's body and develop his sense of balance includes an elongated, horizontally disposed frame structure having front and rear ends and a spring-mounted, padded body rest section extending longitudinally along an upper side portion thereof. The frame structure is supported in an elevated position by front and rear support leg pairs pivotally connected at their upper ends to the front and rear frame structure ends on opposite sides thereof. Each of the support legs is pivoted adjacent its midpoint and is spring-biased to a straightened position. The front legs are provided with handgrips which, when twisted, operate push-pull cable structures to rearwardly bend the legs. The rear legs may be rearwardly bent using similar push-pull cable structures operated by stirrup-like foot pivot mechanisms. To use the machine, the exerciser lies in a prone position atop the body rest section, hooks his feet into the foot pivot mechanisms, and reaches forwardly and grasps the handgrips. While balancing himself on the shifting frame structure, the exerciser, in an appropriate sequence, operates the handgrips and foot pivots to rearwardly bend and straighten the support legs, and forcibly pivots the support legs relative to the frame structure, to cause the machine to "walk" forwardly along the floor or other support surface.

11 Claims, 3 Drawing Sheets

BALANCE ENHANCING EXERCISE AND AMUSEMENT APPARATUS

BACKGROUND OF THE INVENTION

The present invention relates generally to exercise equipment and, in a preferred embodiment thereof, more particularly provides a unique exercise machine which may be used to simultaneously strengthen the arms and legs of the user and develop and enhance his sense of balance.

Various types of exercise machines are commonly used to develop and strengthen the arms and legs of the user. For example, a well known type of exercise machine employs a multi-element weight stack that is connected, via a cable and pulley system, to a force input member which, when forcibly moved by a portion of the exerciser's body, is yieldingly resisted by a selectively variable portion of the weight stack that is lifted and then lowered in response to cyclic movement of the input member. Other resistance-type exercise machines are also used to provide aerobic exercise for essentially the entire body of the user.

However, none of these conventional types of exercise machines of which the present applicant is currently aware is designed to simultaneously develop and enhance the user's sense of balance while strengthening his arms and legs. It is accordingly an object of the present invention to provide an exercise machine which exercises and strengthens the user's arms and legs, while at the same time developing his body balance skills.

SUMMARY OF THE INVENTION

In carrying out principles of the present invention, in accordance with a preferred embodiment thereof, an arm and leg-operated exercise machine is provided which simultaneously strengthens the user's arms and legs and develops his sense of balance. The machine includes an elongated body rest structure including a padded body rest member upon which an exerciser may lie in a generally prone operating position. The body rest structure is held in an elevated, generally horizontal position by a pair of centrally jointed front support legs connected at their upper ends to opposite sides of the front end of the body rest structure for pivotal motion relative thereto about horizontal axes generally transverse to the body rest member, and a pair of centrally jointed rear support legs connected at their upper ends to opposite sides of the rear end of the body rest structure for pivotal motion relative thereto about horizontal axes generally transverse to the body rest structure. To pivotally mount the support legs to the body rest structure, front and rear support block pairs are pivotally mounted to the upper support leg ends and to front and rear support bracket pairs to which the front and rear ends of the body rest member are secured by shock absorbing spring members.

Each of the front and rear support leg members is bendable about its central joint between straightened and rearwardly flexed positions, and spring means are operatively associated with each leg member to bias it toward its straightened position. Hand control means are associated with each of the front support leg members and are engageable by the hands of an exerciser in the aforementioned operating position on the body rest member, and are operable by the exerciser to selectively straighten, rearwardly bend, and pivot their associated front support leg member. In a similar manner, foot control means are associated with each of the rear support leg members, are engageable by the feet of the exerciser, and are operative to selectively straighten, rearwardly bend, and pivot their associated rear support leg members.

To use the machine, the exerciser, while balanced in a generally prone position atop the body rest member, utilizes the hand control means on one of the front support leg members, and the foot control means on one of the rear support leg members, to rearwardly bend, forwardly pivot, and then straighten these two leg members while balancing on the other two leg members and leaning forwardly on the body rest member. The other two leg members are then rearwardly flexed, forwardly pivoted, and straightened. This sequence is repeated to cause the machine to "walk" forwardly across the floor or other support surface to thereby simultaneously strengthen the exerciser's body while developing his sense of balance.

DETAILED DESCRIPTION

Figure 1:
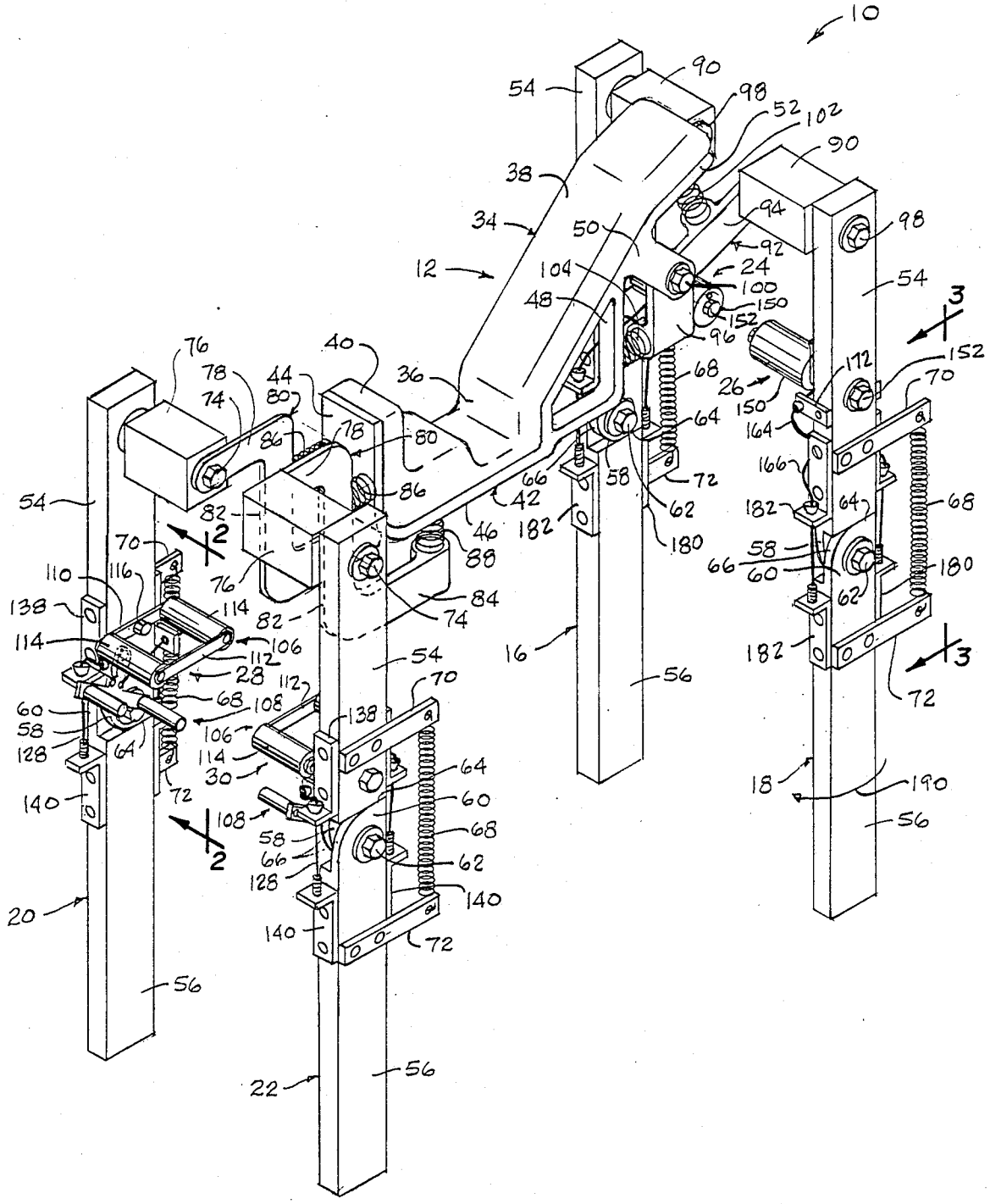
FIG. 1 is a perspective view of a balance enhancing exercise machine which embodies principles of the present invention.

Perspectively illustrated in FIG. 1 is a balance enhancing exercise machine 10 which embodies principles of the present invention and is utilized in a manner subsequently described to strengthen an exerciser's body while at the same time enhancing his sense of balance. The primary components of the exercise machine 10 include an elongated body rest or support structure 12 adapted to support an exerciser 14 (FIGS. 5–9) in a generally prone position, elongated left and right front support legs 16 and 18 pivotally associated at their upper ends with the body rest structure, elongated left and right rear support legs 20 and 22 pivotally associated at their upper ends with the body rest structure, hand control means 24 and 26 operable in a manner subsequently described to control the operation of the front legs 16 and 18, and foot control means 28 and 30 operable in a manner subsequently described to control the operation of the rear legs 20 and 22.

As illustrated in FIGS. 5–9, the body rest structure 12 is held in an elevated, generally horizontal position relative to a supporting surface such as a floor 32 by the front and rear support legs. As later described herein, with the exerciser 14 lying in a generally prone position on the body rest structure 12, the hand and foot control means may be operated by the exerciser to cause the machine 10 to "walk" forwardly across the floor 32 in a manner strengthening the exerciser's body while at the same time developing his sense of balance.

Referring again to FIG. 1, the body rest structure 12 includes an elongated padded upper support member 34 having a downwardly indented rear seat rest section 36, a forwardly and upwardly sloped chest engagement portion 38, and an upturned rear end portion 40. Extending along and secured to the undersurface of the padded body support member 34 is a metal frame structure 42 having an upturned rear end portion 44, a bottom rear portion 46 underlying the seat rest section 36, a pair of generally L-shaped depending brackets 48 underlying opposite rear side edge portions of the chest engagement section 38, a pair of downwardly and forwardly sloped tabs 50 positioned forwardly of the brackets 48, and a front end portion 52.

Figure 6:
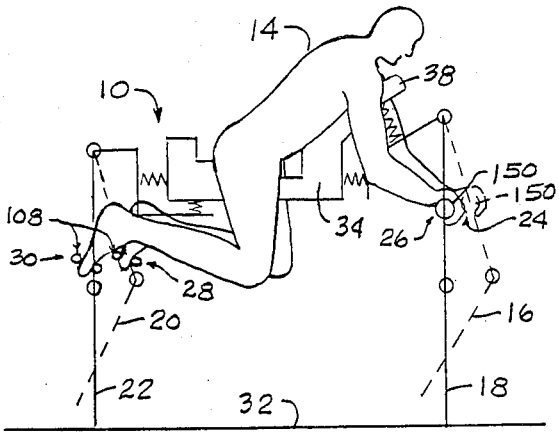
Figure 7:
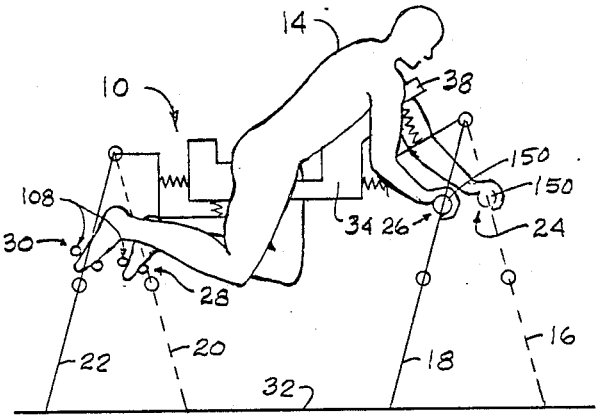
Figure 8:
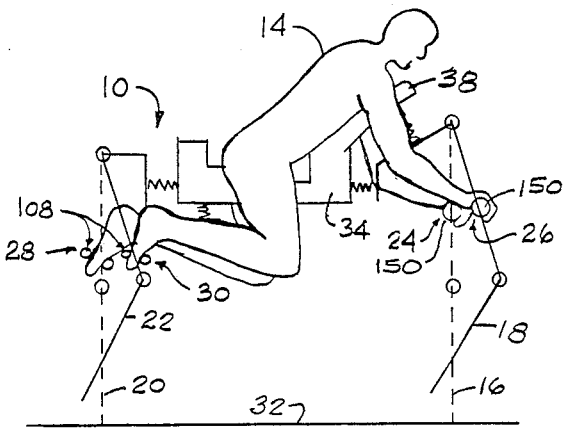

Each of the support legs 16, 18, 20 and 22 has a rectangularly cross-sectioned upper longitudinal section 54 and a rectangularly cross-sectioned lower longitudinal section 56, the facing end portions of such longitudinal sections being laterally notched to form longitudinal end tabs 58 and 60 on the upper and lower leg sections 54 and 56, respectively. Each of the tabs 58, 60 is received in the lateral notch associated with the other tab, and the tabs 58, 60 are pivotally connected at each support leg by a suitable bolt 62 to form in such leg a central joint which permits the leg to be flexed between a straightened position illustrated in FIG. 1, and a rearwardly bent position as illustrated in FIGS. 6 and 8.

Each of the tabs 58 and 60 is provided at its outer end with a forwardly disposed flat section 64 which engages the opposite leg section and prevents the leg from being forwardly bent beyond its straightened position depicted in FIG. 1, and a curved, rearwardly disposed surface 66 which permits rearward flexure of the leg. The support leg members 16, 18, 20 and 22 are biased toward their straightened positions by means of elongated coil spring elements 68 interconnected at their opposite ends to elongated upper and lower connecting members 70 and 72 anchored to the upper and lower longitudinal sections 54 and 56 of each of the support legs. It can be seen that rearward flexure of any of the illustrated support legs tensions its associated spring element 68 so that when the rearward flexure force is removed from the support leg, the tensioned spring 68 tends to pivotally drive the leg toward its normal straightened position.

The upper ends of the rear upper leg sections 54 are pivoted to the previously described body rest structure by means of a pair of bolts 74 which are extended through the rear upper leg sections 54, a pair of rear support blocks 76, and the rearwardly directed end legs 78 of a pair of mounting brackets 80 having central body portions 82 and forwardly directed bottom leg portions 84. As illustrated in FIG. 1, a pair of shock absorbing springs 86 are intersecured at their opposite ends to the bracket body portions 82 and the rear end portion 44 of the frame 42, and a pair of shock absorbing springs 88 (only one of which is visible in FIG. 1) are interconnected at their opposite ends to the outer ends of the lower bracket legs 84 and the bottom rear portion 46 of the frame 42.

The upper longitudinal sections 54 of the front support legs 16 and 18 are pivotally connected in a generally similar manner to a front end portion of the overall body rest structure by means of a pair of front support block members 90 and a pair of front mounting brackets 92 (only one of which is visible in FIG. 1) each having a front leg portion 94 and a downwardly extending rear leg portion 96. Suitable bolts 98 are extended through the upper ends of the front support legs sections 54, the support blocks 90, and the forward ends of the bracket legs 94 to thereby pivotally connect the front support legs 16 and 18 to the brackets 92 for pivotal motion relative thereto (like the rear support legs) about generally horizontal axes transverse to the body rest structure 12. Central portions of the brackets 92 are pivotally connected to the outer ends of the frame tabs 50 by bolts 100. A pair of shock absorbing coil spring members 102 are anchored at their opposite ends to central portions of the bracket legs 94 and the underside of the front frame end portion 52, and a pair of shock absorbing coil spring members 104 are anchored at their opposite ends to front portions of the frame brackets 48 and lower end portions of the rear bracket legs 96.

As can be seen in FIG. 1, the front and rear bracket pairs 92 and 80, together with their associated coil spring elements 102, 104, 86 and 88, define a shock absorbing mounting system which operatively interconnects the body rest structure 12 to upper ends of the front and rear support leg members 16, 18, 20 and 22. During use of the machine 10 in a manner subsequently described, pivotal movement of the brackets 80 and 92 caused by vertical, forward and rearward movement of the padded support member 34 and its associated frame 42 relative to the support legs is resiliently resisted by the previously described spring members associated with the front and rear brackets 92 and 80. It can also be seen that, as previously mentioned, each of the four elongated support legs is pivotally connected to the overall body rest structure defined by the padded member 34 and its support frame 42, the front and rear mounting brackets 92 and 80, and their associated shock absorbing spring elements, for pivotal movement relative to the body rest structure 12 about horizontal axes generally transverse thereto.

Figure 2:
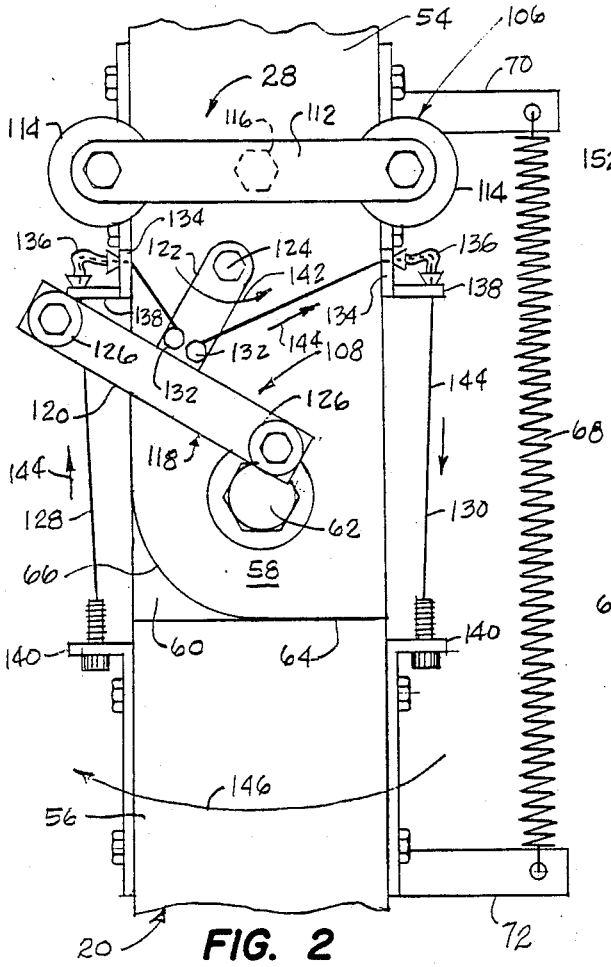
FIG. 2 is an enlarged scale inner side elevational view of a central portion of the left rear support leg of the machine, taken along line 2—2 of FIG. 1.

Referring now to FIGS. 1 and 2, each of the foot control means 28 and 30 include a foot brace structure 106 and a foot pivot structure 108. Foot brace structure 108 comprises a pair of elongated connecting members 110 and 112 secured at their opposite ends to the opposite ends of a pair of padded cylindrical members 114. Each of the elongated connecting members 110 is anchored by a suitable fastening member 116 to a lower inner side surface portion of one of the upper sections 54 of the rear support legs 20 and 22 so that the two foot brace structures 106 project laterally inwardly from the rear support legs with the connecting members 110 and 112 extending generally horizontally as illustrated in FIG. 1.

Each of the foot pivot structures 108 is positioned beneath one of the foot brace structures 106 and includes a generally T-shaped pivot bracket member 118 (see FIG. 2) having an elongated base portion 120 and a transverse central portion 122. The outer ends of the central pivot bracket portions 122 are pivotally connected to the inner side surfaces of the rear support legs sections 54, below the foot brace structures 106, by means of suitable pivot connection members 124. Extending laterally inwardly from the opposite ends of each of the bracket base portions 120 is a pair of padded, elongated cylindrical foot engagement members 126.

As illustrated in FIG. 2 in conjunction with the left foot control means 28, a pair of cable members 128 and 130 are operatively associated with each of the foot pivot structures 108. The inner ends of the cables 128, 130 are anchored to the central pivot bracket member portion 122, as at points 132, and are extended outwardly from these anchor points through guide members 134, sheaths structures 136, and support brackets 138 secured to opposite front and rear side edges of the rear support leg sections 54, the cables 128 and 130 being anchored at their outer, lower ends to a pair of support brackets 140 anchored to the rear support leg section 56.

To operate the foot control means 28 and 30, the exerciser 14 extends his feet downwardly through the foot brace structures 106, between the pairs of padded cylindrical members 114, and into the foot pivot structures 108 between their associated pairs of foot engagement members 126. With the exerciser's feet braced against the stationary members 114, the feet may be used to press against appropriate ones of the foot engagement members 126 to pivot the bracket members 118 in a selected direction about their pivot points 124.

As representatively illustrated in FIG. 2, pivoting in this manner of the left pivot bracket member 118 in a counterclockwise direction indicated by the arrow 142 moves the cables 128, 130 in the directions indicated by the arrows 144 to thereby rearwardly bend the lower section 56 of the support leg 20, as indicated by the arrow 146, to thereby rearwardly flex the support leg 20 against the resilient biasing force of its associated spring member 68. By pivoting the bracket 118 in the opposite direction, the cable movement directions are reversed to return the leg 20, with the assistance of its spring 68, to its fully straightened position. Appropriate forward or rearward movement of the exerciser's foot, which is braced against one of the padded members 114, can also be used to forwardly or rearwardly pivot the particular rear support leg relative to the body rest structure 12.

Figure 3:
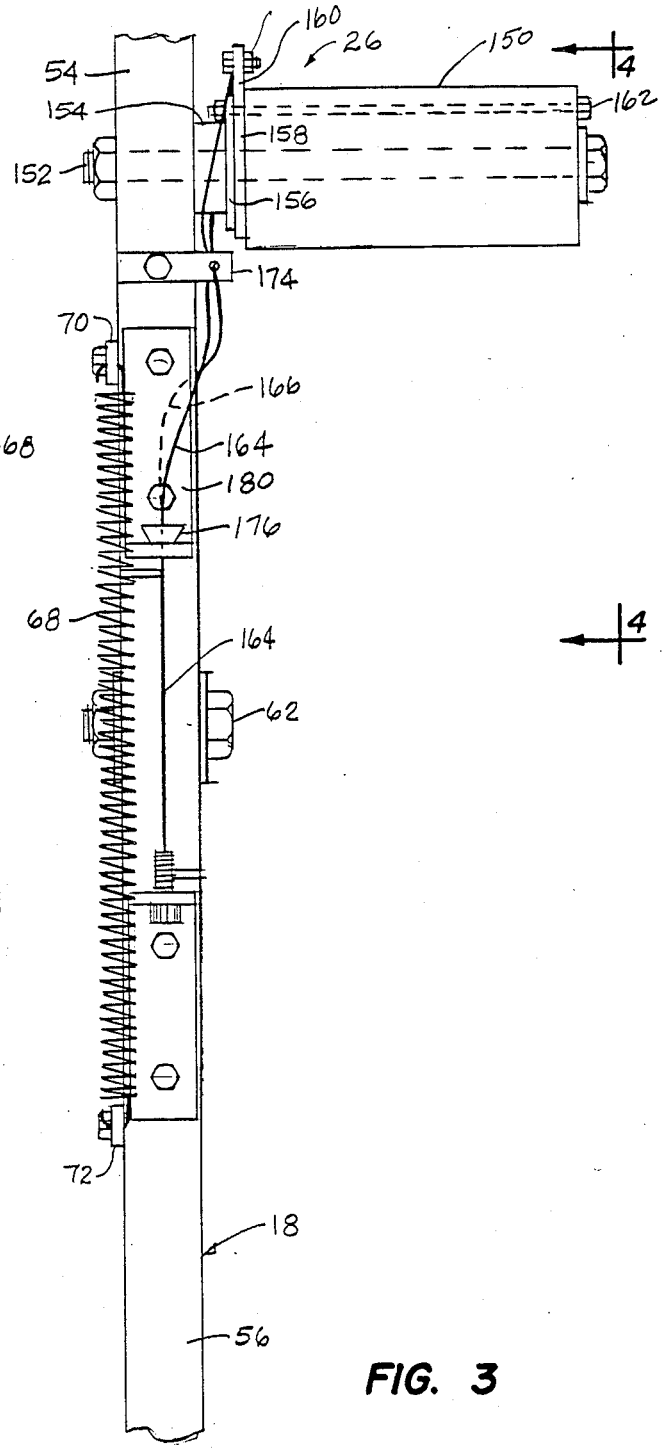
FIG. 3 is an enlarged scale front elevational view of a central portion of the right front support leg of the machine, taken along line 3—3 of FIG. 1.
Figure 4:
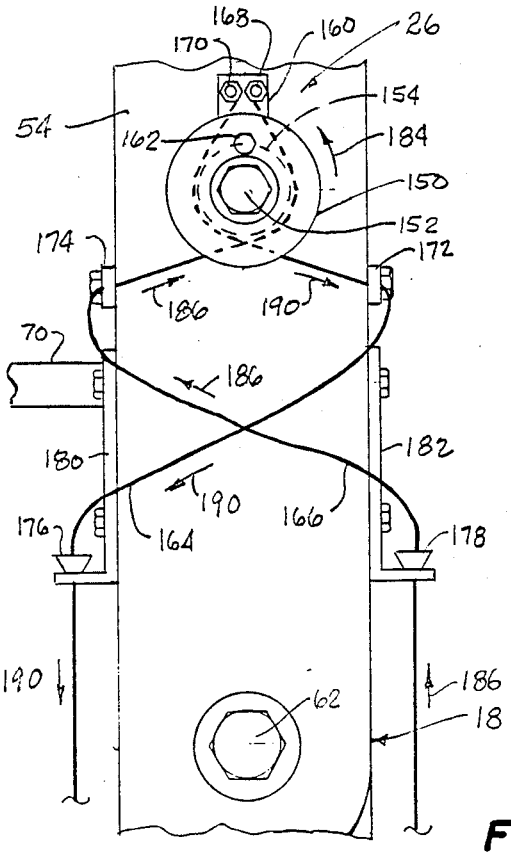
FIG. 4 is an inner side elevational view of a portion of the right front support leg, taken along line 4—4 of FIG. 3.
Figure 5:
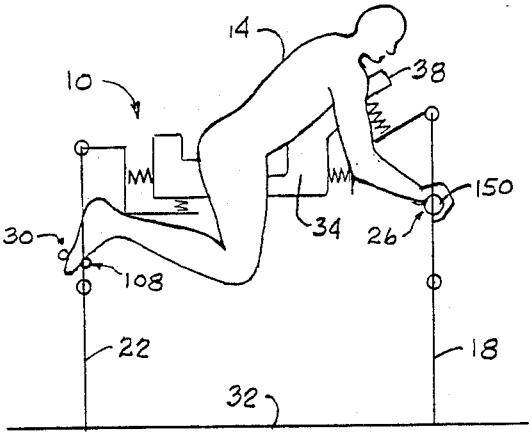
FIGS. 5–9 are schematic diagrams of the machine sequentially illustrating its use by an exerciser operatively positioned thereon, the left front and left rear support legs of the machine being illustrated with dotted lines for illustrative clarity.

Referring now to FIGS. 3 and 4, the hand control means 24 and 26 mounted on the front support legs 16 and 18 each comprise a padded twist grip member 150 rotatably secured to one of the front support leg upper sections 54 by a bolt 152. Each of the twist grips 150 has a reduced diameter inner end section 154 positioned against the upper leg section 54 and encircled by a washer 156 and an annular drive member 158 having a radial tab 160 thereon. The washer 156 and the drive member 158 are anchored to the twist grip 150 for rotation therewith by means of a retaining bolt 162 extending axially through the twist grip and the members 156 and 158. A pair of elongated cable members 164, 166 are secured at upper ends thereof, at points 168 and 170, to the tab 160, are wrapped around the twist grip inner end section 154, are passed outwardly through apertures formed in suitable guide members 172, 174 anchored to opposite side edges of the front support leg upper sections 54, are crossed as best illustrated in FIG. 4, are extended downwardly through bushing elements 176, 178 secured to mounting flanges 180, 182 anchored to the leg sections 154 below the guide members 172 and 174, and are anchored at their lower ends to flanges 180, 182 (FIG. 1) anchored to the front support leg lower sections 56.

The twist grips 150 may be used to selectively pivot and/or bend the front support legs 16 and 18. For example, either of the front support legs 16 and 18 may be forwardly pivoted relative to the body rest structure 12 by simply pushing its associated twist grip 150 forwardly. Rearward pivoting of either of the front support legs 16 and 18 may be effected simply by pulling its associated twist grip. Rearward bending of either of the front support legs may be effected by forwardly twisting its associated twist grip 150. As illustrated in FIG. 4 in conjunction with the front support leg 18, such forward twisting of its twist grip 150, as indicated by the arrow 184, pulls the cable 166, as indicated by the arrows 186, while pushing the cable 164, as indicated by the arrows 190, to cause rearward bending of the support leg 18 as indicated by the arrow 190 in FIG. 1. Forward bending of the front support legs, assisted by their biasing springs 68, is effected by twisting the grips 150 rearwardly.

Referring now to FIGS. 5–9, to use the machine 10, the exerciser 14 lies in a generally prone position on the padded seat rest portion 34 with his chest engaging its chest engagement portion 38 as illustrated. The exerciser extends his feet downwardly through the foot brace structures 106 (FIGS. 1 and 2) into the space between the foot engagement member portions 126 of the foot pivot structures 108, and reaches forwardly with his hands to grasp the twist grip members 150. Initially, the exerciser balances on the body rest structure 12 with the front and rear support legs in their straightened, essentially vertical orientations depicted in FIG. 5. The exerciser then operates the left foot control means 28 and the left front twist grip 150 as previously described to rearwardly bend and forwardly pivot the left front and rear support legs 16 and 20, as illustrated in FIG. 6, while balancing on the right front and rear support legs 18 and 22. The exerciser then leans forwardly and straightens the left front and rear support legs 16 and 20 to bring the machine 10 to its orientation depicted in FIG. 7 in which the right front and rear support legs 18 and 22 are forwardly tilted. At this point, the exerciser is again balanced on all four of the support legs.

Figure 9:
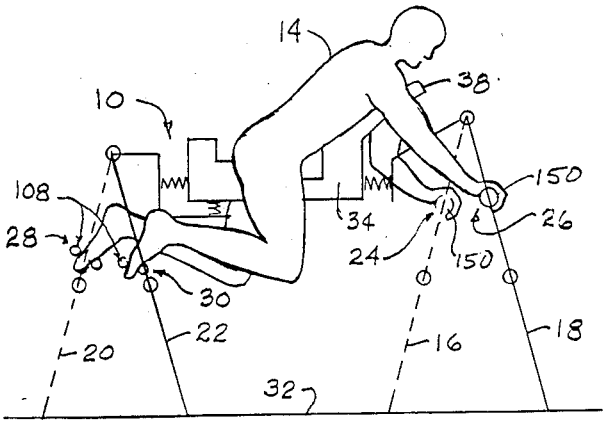

Next, the right hand and foot of the exerciser are used to operate the right twist grip member 150 and the right foot control means 30 to rearwardly bend and forwardly pivot the right front and rear support legs 18 and 22 (FIG. 8) while using his left arm and leg to bring the left front and rear support legs 16 and 20, upon which the exerciser is balanced, to their essentially vertical positions shown in FIG. 8. Finally, the exerciser leans forwardly to forwardly tilt the straightened left front and rear support legs 16 and 20 while simultaneously straightening the right front and rear support legs 18 and 20 to again bring their lower ends into engagement with the floor 32 as shown in FIG. 9.

This described cycle of support leg movements is then repeated to cause the machine 10 to walk forwardly across the floor 32 while the exerciser is balanced on the bodyrest structure. In this manner, the arms and legs of the exerciser 14 are strengthened, while at the same time the exerciser's sense of balance is being developed. While the use of the machine 10 has been described with the left support legs and right support legs being alternately moved together, it will be appreciated that the machine 10 could also be utilized, with, for example, the right front support leg and the left rear support leg being moved simultaneously during one half of the movement cycle, and the left front and right rear support legs being moved simultaneously during the other half of the movement cycle.

It can seen from the foregoing that the present invention provides unique exerciser apparatus which simultaneously strengthens the arms and legs of an exerciser while at the same time challenging and developing his sense of balance. The machine 10 may be fabricated from relatively inexpensive, readily available standard components, is of a quite rugged construction, and may be compactly stored by, for example, pivoting the rear support legs forwardly beneath the body rest structure and pivoting the front support legs in a counterclockwise direction so that they extend generally rearwardly across the top of the body rest structure. The foregoing detailed description is to be clearly understood as being given by way of illustration and example only, the spirit and scope of the present invention being limited solely by the appended claims.

What is claimed is:

1. Balance developing exercise apparatus comprising:

support means for supporting an exerciser, said support means having spaced apart front and rear portions;

front leg means, pivotally connected to said front portion of said support means, for engaging a support surface and supporting said front portion in an elevated position relative thereto;

rear leg means, pivotally connected to said rear portion of said support means, for engaging the support surface and supporting said rear portion in an elevated position relative thereto, said front and rear leg means being operatively pivotable relative to said support means to cause said apparatus to walk across the support surface with the exerciser balanced on said support means, said front and rear leg means additionally being bendable, about generally central portions thereof, between straightened and rearwardly flexed positions; and control means carried by said front and rear leg means and forcibly movable by the hands and feet of the exerciser to operatively pivot said front and rear leg means, said control means being further operative to flex and straighten said front and rear leg means whereby, by forcibly moving said control means, the arms and legs of the exerciser are exercised and strengthened, and the exerciser's balance ability is developed during walking movement of said apparatus along the support surface.

2. The exercise apparatus of claim 1 further comprising:

means for biasing said front and rear leg means toward their straightened positions.

3. Balance developing exercise apparatus comprising:

elongated, horizontally positionable support means for supporting an exerciser in a generally prone operating position, said support means having spaced apart front and rear end portions;

leg means for engaging a support surface and holding said support means in an elevated, generally horizontal orientation relative thereto, said leg means including:

first and second elongated front leg members secured at upper ends thereof to opposite sides of said front end portion of said support means for pivotal motion relative to said support means about a generally horizontal first axis transverse to the longitudinal extent of said elongated support means, each of said front leg members being centrally jointed in a manner permitting it to be flexed between straightened and rearwardly bent positions, and having a lower end adapted to engage said support surface, and first and second elongated rear leg members secured at upper ends thereof to opposite sides of said rear end portion of said support means for pivotal motion relative to said support means about a generally horizontal second axis transverse to the longitudinal extent of said elongated support means, each of said rear leg members being centrally jointed in a manner permitting it to be flexed between straightened and rearwardly bent positions, and having a lower end adapted to engage said support surface;

first and second hand control means respectively associated with said first and second front leg members, engageable by the hands of an exerciser in said operating position on said support means, and operative by the exerciser to selectively straighten, rearwardly bend, and pivot their associated front leg member; and first and second foot control means respectively associated with said first and second rear leg members, engageable by the feet of an exerciser in said operating position on said support means, and operative by the exerciser to selectively straighten, rearwardly bend, and pivot their associated rear leg member, whereby an exerciser balanced on said support means in said operating position may utilize said hand and foot control means to cause said apparatus to walk forwardly along said support surface, by cyclically bending, pivoting and straightening said leg members in a predetermined sequence, to thereby simultaneously exercise his body and develop his sense of balance.

4. The exercise apparatus of claim 3 wherein:

said first and second hand control means each comprise twist grip means operative to forwardly and rearwardly pivot one of said first and second front leg members, and cable means responsive to rotation of said twist grip means for bending said one of said first and second front leg members between its straightened and rearwardly bent position.

5. The exercise apparatus of claim 3 wherein:

said first and second foot control means each comprise foot pivot means pivotable by a foot of the exerciser relative to one of said rear leg members, and cable means responsive to pivoting of said foot pivot means for bending said one of said rear leg members between its straightened and rearwardly bent positions.

6. The exercise apparatus of claim 5 wherein:

said first and second foot control means each additionally comprise foot brace means for bracing the exerciser's feet to assist in the operation of said foot pivot means.

7. The exercise apparatus of claim 3 further comprising:

spring means for biasing said front and rear leg members toward their straightened positions.

8. Balance developing exercise apparatus comprising:

support means for supporting an exerciser, said support means having spaced apart front and rear portions;

leg means for engaging a support surface and holding said support means in an elevated position relative thereto, said leg means including:

first and second elongated, centrally jointed front support leg members connected at upper end portions thereof to said front portion of said support means for pivotal motion relative thereto about generally horizontal axes essentially transverse to the front-to-rear extent of said support means, and being bendable about their central joints between essentially straight and rearwardly flexed positions, and first and second elongated, centrally jointed rear support leg members connected at upper end portions thereof to said rear portion of said support means for pivotal motion relative thereto about generally horizontal axes essentially transverse to the front-to-rear extent of said support means, and being bendable about their central joints between essentially straight and rearwardly flexed positions, said front and rear support leg members, in a predetermined sequence thereof, being bendable, pivotable and straightenable in a manner causing said apparatus to walk across the support surface;

foot control means mounted on said rear support leg members, engageable by the feet of an exerciser balanced on said support means, and operative by the exerciser's feet to forcibly bend, pivot and straighten a selected one of said rear support leg members; and hand control means mounted on said front support leg members, engageable by the hands of an exerciser balanced on said support means, and operative by the exerciser's hands to forcibly bend, pivot and straighten a selected one of said front support leg members, said hand control means including:

twist grip means rotatably connected to said front support leg members and graspable by the hands of the exerciser, said twist grip means being pushable to forwardly pivot said front support leg members, and pullable to rearwardly pivot said front support leg members, and cable means, interconnected between said twist grip means and said front support leg members and responsive to rotation of said twist grip means, for bending said front support leg members.

9. The exercise apparatus of claim 8 further comprising:

spring means for biasing said front and rear support leg members toward their straightened positions.

10. Balance developing exercise apparatus comprising:

support means for supporting an exerciser, said support means having spaced apart front and rear portions;

leg means, for engaging a support surface and holding said support means in an elevated position relative thereto, said leg means including:

first and second elongated, centrally jointed front support leg members connected at upper end portions thereof to said front portion of said support means for pivotal motion relative thereto about generally horizontal axes essentially transverse to the front-to-rear extent of said support means, and being bendable about their central joints between essentially straight and rearwardly flexed positions, and first and second elongated, centrally jointed rear support leg members connected at upper end portions thereof to said rear portion of said support means for pivotal motion relative thereto about generally horizontal axes essentially transverse to the front-to-rear extent of said support means, and being bendable about their central joints between essentially straight and rearwardly flexed positions, said front and rear support leg members, in a predetermined sequence thereof, being bendable, pivotable and straightenable in a manner causing said apparatus to walk across the support surface;

hand control means mounted on said front support leg members, engageable by the hands of an exerciser balanced on said support means, and operative by the exerciser's hands to forcibly bend, pivot and straighten a selected one of said front support leg members; and foot control means mounted on said rear support leg members, engageable by the feet of an exerciser balanced on said support means, and operative by the exerciser's feet to forcibly bend, pivot and straighten a selected one of said rear support leg members, said foot control means including:

foot engagement means engageable by the feet of the exerciser and having foot operable first portions pivotally connected to said rear support leg members, and foot operable second portions anchored to said rear support leg members, said second portions being pullable to forwardly pivot said rear support leg members and pushable to rearwardly pivot said rear support leg members, and cable means, interconnected between said first portions of said foot engagement means and said rear support leg members and responsive to pivotal movement of said first portions, for bending said rear support leg members.

11. The exerciser apparatus of claim 10 further comprising:

spring means for biasing said front and rear support leg members toward their straightened positions.

* * * * *